United States Patent [19]

Knox

[11] Patent Number: 4,516,523

[45] Date of Patent: May 14, 1985

[54] APPARATUS FOR WETTING APERTURED DISCS

[76] Inventor: David J. Knox, 13016 Ladana Ct., Santa Fe Springs, Calif. 90670

[21] Appl. No.: 562,227

[22] Filed: Dec. 16, 1983

[51] Int. Cl.[3] ..... B05C 13/02

[52] U.S. Cl. ..... 118/500; 118/416; 118/426; 134/142; 134/149; 134/159; 134/161

[58] Field of Search ..... 118/416, 426, 500; 134/142, 149, 158, 159, 161

[56] References Cited

U.S. PATENT DOCUMENTS

| | | | |
|---|---|---|---|
| 1,134,809 | 4/1915 | Beadle | 118/426 X |
| 1,850,409 | 3/1932 | Meyer | 118/416 X |
| 2,818,044 | 12/1957 | Booty, Jr. et al. | 118/426 |

*Primary Examiner*—John D. Smith
*Assistant Examiner*—Bernard F. Plantz
*Attorney, Agent, or Firm*—Dominick Nardelli

[57] ABSTRACT

The apparatus is capable of being immersed in a liquid bath and supports at least two dowels or rods on which are mounted apertured discs in spaced apart relationship. Each rod has a gear fixed near one end and has a plurality of axially spaced circumferential grooves in each of which respective apertured discs are disposed. A pair of spaced wheels are provided to rotate in unison about a fixed axle. Each wheel has a plurality of radially disposed slots into which respective rods are disposed so that each dowel is capable of rotating about its own axis. The axle supports a fixed sun gear disposed near one wheel and each rod has at one end a planet gear that meshes with the sun gear whenever the respective rod is nested within a respective pair of slots on the wheels. Means are provided to rotate said pair of wheels about said axle. To prevent the rods from falling out of their respective slots as the wheels rotate, a C-shaped keeper device is disposed around each wheel and in a fixed position. The opening in the device extends upward so that each of said rods can be, in turn, mounted and removed from said wheels while the remaining rods are supported in place.

3 Claims, 3 Drawing Figures

APPARATUS FOR WETTING APERTURED DISCS

FIELD OF THE INVENTION

The present invention relates to an apparatus for wetting discs and, more particularly, to an apparatus for removably supporting within a liquid at least two rods on which the discs are mounted so that each disc rotates about its own axis and the respective axis is moved within the liquid.

BACKGROUND OF THE INVENTION

During the manufacture and remanufacture of discs used in conjunction with, for example, computers, the discs must be washed, plated and etched clean of foreign matter of various types. Some of these fluids are caustic or otherwise harmful to an operator which precludes manual handling during some or all steps of the washing, plating or etching process. To accommodate high volume handling of the discs on the order of 10,000 or more discs per day, every possible step must be taken to minimize handling, loading and unloading of the discs onto and off of supporting structures. Physical damage in the form of scratches, nicks, bent discs, etc., must be eliminated to the extent possible to maintain a low scrap rate of the discs due to such damage. Therefore both opposed surfaces of each disc must be totally and uniformly washed or plated; any and all mechanisms for supporting the discs must accomodate exposure of the complete disc surfaces to washing or plating liquid; and, the opposed surfaces must be uniformly subjected to the various washing and plating fluids.

SUMMARY OF THE INVENTION

The present invention is an apparatus or rack having a pair of spaced side plates or panels which are mounted together. Fixed to each side plate and perpendicular thereto is an axle on which is rotatably mounted a pair of spaced wheels. Near one of the wheels is fixedly mounted onto said axle a sun gear and each wheel has a plurality of radially disposed slots formed therein. The slots on one wheel being aligned with the respective slots on the other wheel so that a rod, which is removably mounted within a slot on one wheel and a corresponding slot on the other wheel, is disposed parallely to said axle. Each rod has a gear which meshes with said sun gear and means are provided to rotate both wheels in unison about said axle. This ensures that each disc rotates about its own axis and also moves up and down and laterally through the liquid. To allow mounting and removal of said rods onto said pair of wheels and to prevent said rods from falling off therefrom as said wheels rotate, a C-shaped keeper is fixedly disposed about each wheel whereby the radially extending gap in both said keepers is preferably disposed on the upper side thereof.

OBJECT OF THE INVENTION

It is therefore a primary object of the present invention to provide a rack for supporting a plurality of rods supporting apertured discs during washing or plating or both operations.

Another object of the present invention is to provide a plurality of rods removably supported on a pair of wheels, each of which rods penetrably support a plurality of apertured discs in fixed position the length thereof.

Still another object of the present invention is to provide a gear fixed to a wash rack which gear automatically engages a gear on each disc supporting rod on removably mounting the rods from the rack.

Yet another object of the present invention is to provide motive means for rotating a pair of spaced wheels in unison about the same axis defined by a fixed gear.

A yet further object of the present invention is to provide a method for removably mounting groups of discs upon a wash or plating rack.

A yet further object of the present invention is to provide a method for automatically engaging disc supporting rods with a gear train to effect rotation of the discs eccentrically of the respective dowels upon removably locating the dowels in a wash or plating rack.

These and other objects and features of advantages of the present invention will become more apparent to those skilled in the art after studying the following description of the preferred embodiment of the present invention together with the appended drawings.

DETAILED DESCRIPTION OF THE DRAWINGS

Figure 1:
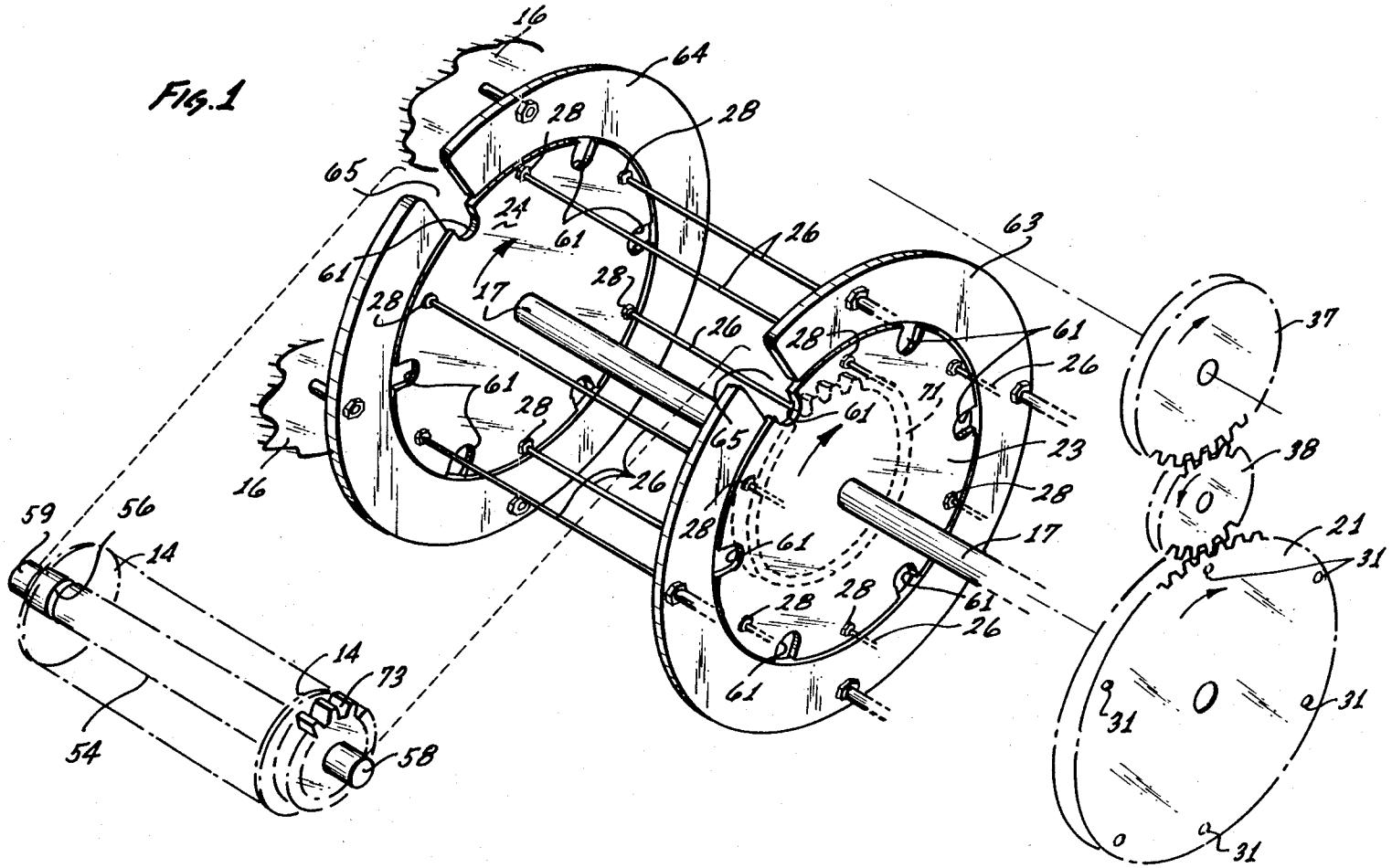
FIG. 1 is an exploded isometric view showing the novel features of the invention.
Figure 3:
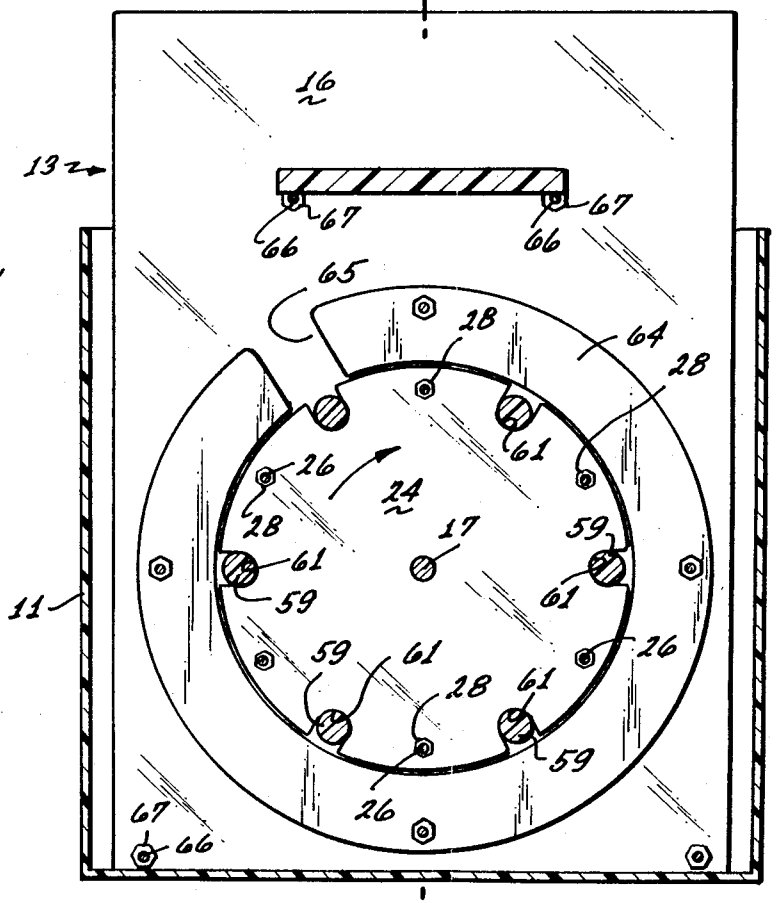
FIG. 3 is a side elevation in section taken on line 3—3 of FIG. 2 in the direction of the arrows.
Figure 2:
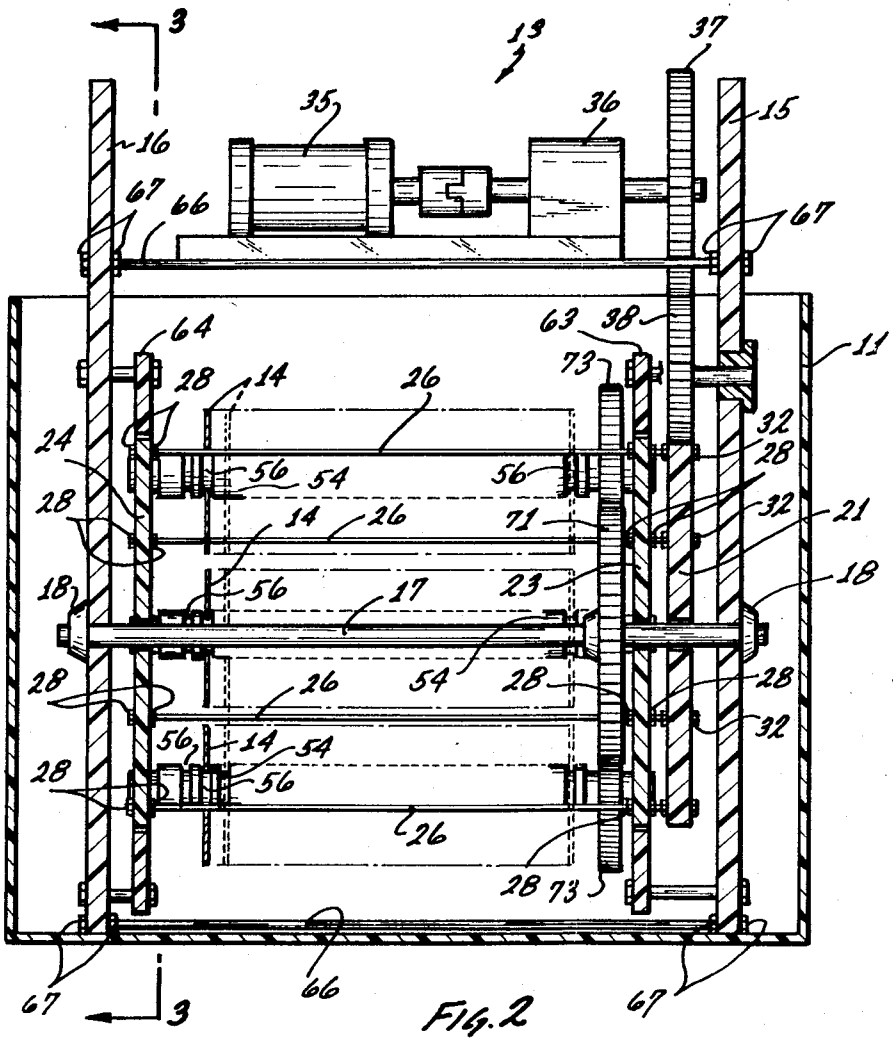
FIG. 2 is a front elevation in section showing a tank with a submersible rack which incorporates the novel features shown in FIG. 1 and more particularly is a section taken on line 2—2 of FIG. 3 in the direction of the arrows.

Referring in particular to FIGS. 2 and 3, there is shown a liquid tank 11 in front and side sectional elevations respectively. Within the tank 11 is a removable rack 13 for supporting a plurality of discs 14 during a washing, plating or other wellknown chemical process. Because of the inherent nature of a chemical process, in order to have a uniform washing, etching, etc., on the discs 14, the discs 14 should be moved within the liquid solution. This procedure is accomplished as follows:

The rack 13 includes a pair of spaced side panels 15 and 16 which are joined and secured to one another, as will become apparent hereinafter. An axle 17 is disposed extending between both side panels 15 and 16 as shown. The axle extends through suitable openings in both side panels and is fixed in place by suitable means, such as collars 18 which are secured to each end of axle 17 as shown, Inward from the panel 15 a drive gear 21 is rotably mounted onto axle 17. Spaced inwardly from the gear 21 is a wheel 23 (more clearly shown in FIG. 1) which is in turn rigidly connected to another clogged-wheel 24 by, for example, six rods 26 threaded at both of their respective ends. The rods 26 are positioned as shown around the axle 17 with one end protruding through wheel 24 and the other end protruding through wheel 23. Suitable nuts 28 are threaded onto each rod 26 and disposed on each side of both wheels 23 and 24 and tightened toward the respective wheels so that both wheels 23 and 24 rotate in unison about the axle 17. As is standard in the art, if one makes the axle 17 out of stainless steel and both wheels 23 and 24 out of plastic such as nylon one finds that rotation between the elements is readily available. In order that gear 21 also rotates in unison with both wheels 23 and 14, each respective rod 26 has its end, protruding through wheel 23, also protruding through respective openings 31 (FIG. 1) formed in gear 21. Then additional nuts 32 are threaded onto each rod 26 as shown in FIG. 3 and secured in place so that gear 21 backs against nuts 28 disposed against the respective side of wheel 23.

Power to turn the gear 21 is supplied by a prime mover such as a suitably mounted electric motor 35 and reduction gear 36 which slowly turns a pinion 37. The pinion 37 is coupled to gear 21 through a suitable idler gear 38 as is standard in the art. In order to slowly agitate the items 14 within the solution (not shown but which would be disposed within the tank 11) the items 14 are mounted onto the periphery of both wheels 23 and 24 in the following manner. Items 14 as described before, are discs with centrally located holes 51 (FIG. 3). More than one disc 14 is threaded on a respective dowel or rod 54 which has a plurality of disc supporting annular grooves 56 spaced evenly along the respective dowel. A disc 14 is placed in each groove 56. At each end of each dowel 54 is an annular depression 58 and 59 which nests in suitable radial recesses 61 formed equally spaced around each wheel 23 and 24. In the embodiment shown, each wheel has six recesses 61, each of which is aligned midway between two adjacent rods 26 for obvious reasons.

To prevent the dowels 54, which are nested in a respective pair of recesses 61, which are moving below the horizontal plane passing through the axle 17, a C-shaped keeper 63 and 64 is fixed around each wheel 23 and 24 respectively. Each keeper 63 and 64 is made of rigid material such as plastic and is supported in spaced relationship from each side panel 15 and 16 respectively. The side panels 15 and 16 are rigidly supported away from each other by suitable means such as is schematically shown in FIG. 3 wherein tie rods 66 and nuts 67 are shown to support each side panel in fixed relationship.

One now understands that when the dowels 54 are nested within their respective recesses 61 in wheels 23 and 24 and gear 21 is turned by the prime mover, the dowels 64 will rotate about the axle 17 and not fall out of the recesses 61. This provides agitation between any solution in the tank 11 and the respective disc 14. To improve agitation, the dowels 54 in this invention are also made to revolve about their own axis in the following manner. On axle 17 adjacent wheel 23 there is fixedly mounted a sun gear 71. Then on each end of each dowel 54 inboard of annular depression 59 there is fixedly mounted to the dowel 54 a planet gear 73. The size of planet gear 73 is such that it meshes with sun gear 71 whenever the dowel is nested within the recesses 61. However, when gear 21 rotates, the dowels 54 rotate about their own axis and also about axle 17.

OPERATION OF THE DEVICE

As shown in FIG. 2 the keeper 64 is annular with a cut-out 65 disposed at an angle of 45 degrees with the horizontal. The cut-out 65 is preferably wider than the recess 61 on wheels 23 and 24. However, for obvious reasons the cut-out 65 should not be narrower than recesses 61.

With the rack 13 removed from the tank 11 (not shown) gear 21 is activated to allow the recesses 61 to pass slowly by both cut-outs 65. Then one inserts a dowel 54 loaded with discs 14 one at a time through cut-out 65 and into recesses 61. When six dowels 54 are thus mounted the rack 13 is lowered into the tank 11. The surface of the solution should of course be below the motor 35 but above the disc 14 as they rotate. After a fixed time the rack 13 can be removed from the tank 11 and lowered into another tank (not shown) whereby the discs can be further processed.

Having described the preferred embodiment of my invention, one skilled in the art can devise other embodiments after studying the above disclosure. Therefore my invention is not to be considered limited to the disclosed embodiment, but include all embodiments falling within the scope of the appended claims.

I claim:

1. An apparatus for wetting a plurality of apertured discs, which are penetrably supported on at least one dowel, said apparatus comprising:

a pair of spaced side panels secured to one another;

an axle fixedly mounted and disposed normal to said both side panels;

a pair of wheels mounted for unison rotation onto said axle and spaced from each other;

each of said wheels having a plurality of radially extending recesses formed at the periphery thereof, the number and spacing of said recesses being such that one of said recesses on one of said wheels is aligned axially parallel to a respective one of said recesses on said other wheel;

a drive gear also mounted for rotation about said axle in unison with said wheels;

a sun gear fixedly mounted on said axle and disposed between said wheels;

each of said dowels being capable of being nested in one of said recesses on one of said wheels and in one of said recesses on said other wheel so that said dowel is parallel to said axle;

each of said dowels having a planet gear fixed thereto and said planet gear being disposed to mesh with said sun gear whenever said respective dowel is nested within said recesses;

means for rotating said wheels and said drive gear;

a C-shaped keeper fixedly disposed and substantially surrounding each of said wheels so that a radially extending slot approximately the same width as the recesses in said wheels, but not narrower than said recesses, is formed therein; and both of said slots being disposed to extend upwardly.

2. The apparatus of claim 1 wherein:

said sun gear is disposed adjacent one of said wheels.

3. The apparatus of claim 2 wherein:

a drive gear is fixed to one of said wheels or its side that is removed from said other wheel;

a prime mover is rigidly supported to said side panels above said axle and said pair of wheels; and means are provided to couple said prime mover to said drive gear for rotation of said drive gear.

* * * * *